United States Patent [19]

Ensor

[11] 4,066,088

[45] Jan. 3, 1978

[54] SMOKE REDUCER FOR CIGARETTE SMOKERS

[76] Inventor: John E. Ensor, 1409 Mount Carmel Road, Parkton, Md. 21120

[21] Appl. No.: 717,919

[22] Filed: Aug. 26, 1976

[51] Int. Cl.[2] ..... A24F 3/00; A24F 47/00

[52] U.S. Cl. ..... 131/185

[58] Field of Search ..... 131/7, 174, 175, 4 R, 131/4 A, 185

[56] References Cited

U.S. PATENT DOCUMENTS

| | | | |
|---|---|---|---|
| 2,366,686 | 1/1945 | Halloran | 131/185 X |
| 2,738,792 | 3/1956 | Smith | 131/185 |
| 3,821,958 | 7/1974 | Overleese | 131/7 X |

*Primary Examiner*—Stephen C. Pellegrino

*Attorney, Agent, or Firm*—John F. McClellan, Sr.

[57] ABSTRACT

A lighter-extinguisher for cigarettes and the like which permits smokers to enjoy smoking with reduced possibility of annoying non-smokers, reduced waste of smoking materials, and with no staining of fingers or scattering of ashes. A cigarette-package-sized device with a cigarette mouthpiece end projecting from it in position for smoking is held in the smoker's hand at all times during smoking of the cigarette; between puffs the cigarette is extinguished by closing a valve to shut off air from the burning end held inside the device, and is conveniently relit when a puff is desired by opening the valve, which automatically actuates the lighter. An ash pit receives ashes down a slide and the lighter mechanism follows the tip, assuring ready re-ignition.

11 Claims, 2 Drawing Figures

SMOKE REDUCER FOR CIGARETTE SMOKERS

This invention relates generally to smoker's apparatus and specifically to cigarette holders and the like.

Cigarette smoking dates from the early 16th Century according to a well known encyclopoedia, and cigar smoking is even older. However, no matter how time-honored the practice, within the past ten years smoking has come under increasing attack on behalf of non-smokers, particularly smoking in public places. On many occasions, smokers are made to feel guilty for permitting smoke to curl upward from an idle cigarette, the thought being that in the long intervals the cigarette is not actively being puffed, it is polluting as much as, if not more than, in the brief intervals it is puffed, and with no justification in giving pleasure to anyone. Smoke which has been inhaled seems by contrast less acrid because filtered through the cigarette and mixed with air.

A principal object of the present invention is therefore to provide smokers with means and method for eliminating air pollution from smoking apparatus between puffs.

Further objects are to provide means and method for eliminating idle burning of smoking materials, finger staining and ash scattering.

A further important provision evident in the invention is the reduction of fire hazards, particularly of fire hazards from smoking in bed.

Still further objects are to provide a device as described which is economical to purchase and to use, which is rugged and reliable in operation, is convenient to carry and which is unobtrusive in appearance and in use.

In brief summary of the invention given for cursive descriptive purposes only and not as limitation the invention contemplates a compact, lightweight unitary holder, lighter, re-lighter, extinguisher, ashtray and shield for materials smoked.

The above and other objects of the invention will become more readily apparent from the following description, including the drawings in which like reference numerals refer to like parts:

Figure 1:
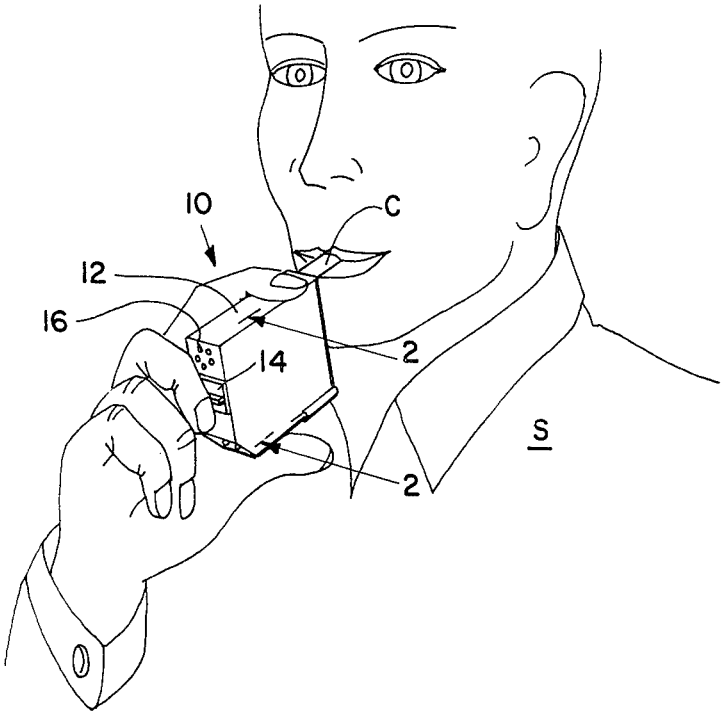
FIG. 1 is an isometric view of the invention in use.

FIG. 1 illustrates the invention 10 hand held with a smoker S lighting a cigarette C protruding from the upper portion of an end of the housing 12. The housing has the general rectangular box shape and size of a package of cigarettes. Sliding switch actuator 14 on the opposite end of the housing is depressed downward by the user, switching on an electric lighter within the unit in contact with the other end of the cigarette. Sliding the actuator to ignite the cigarette uncovers vent 16 adjacently above the switch, admitting air into the otherwise tight enclosure around the cigarette.

In operation, to suppress pollution the user simultaneously draws on the cigarette and inhales, then returns the switch actuator upwardly to the "off" position, shutting off current to the lighter and air to the cigarette which extinguishes without emitting further smoke.

For each succeeding inhalation the smoker repeats the process, the only smoke escaping being that inhaled. For confirmed users who inhale only at moderate intervals it is estimated that this provision of the invention can save the bulk of pollution of the surrounding air, and several dollars each week besides. In addition the smoker's fingers are protected from staining, since the housing of the invention is air tight except when air is actually being drawn into it. The smoker and his surroundings are protected from the hazard of an exposed, burning object.

Figure 2:
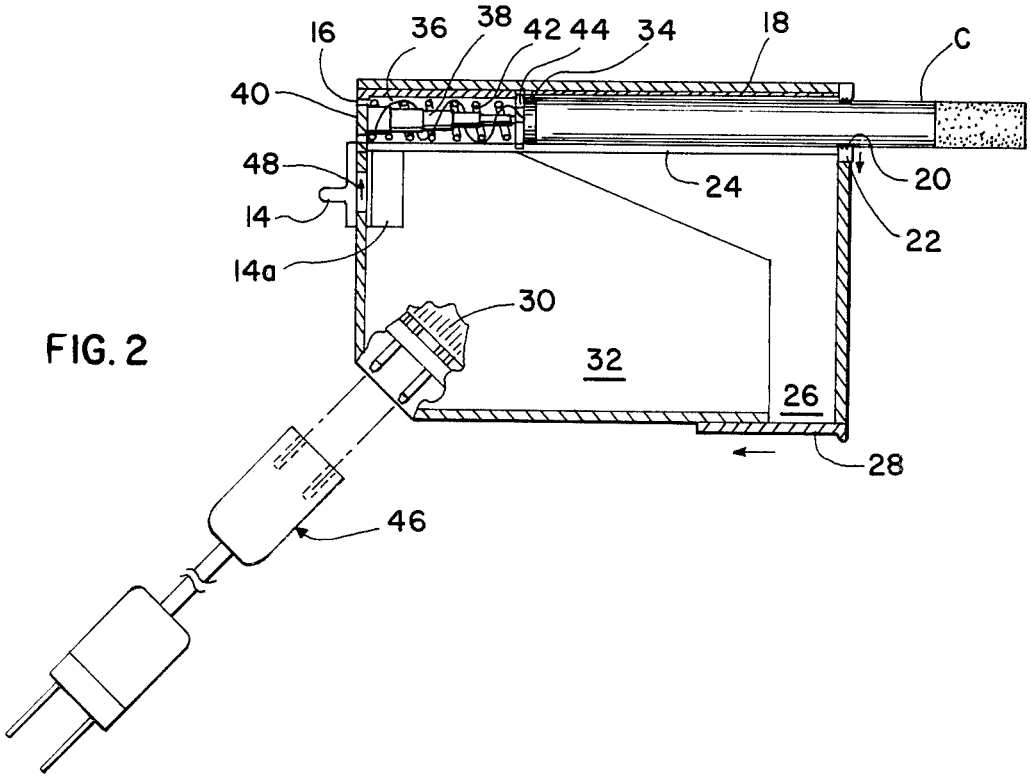
FIG. 2 is an elevational view partially in section taken at 2—2, FIG. 1.

FIG. 2 illustrates interior provisions and further features of the invention making possible and practical the operational advantages described.

The cigarettes is retained in a tube 18 by a friction member such as a toothed clip 20 which may be hinged or sprung, at the entrance. A tab 22 may be provided to open the clip and release the cigarette. A slot 24 in the bottom of the tube permits ashes to drop to ash pit 26 from which they can be released through the sliding door 28.

Switch 14*a* connects a battery 30 inside enclosure 32 with a thermal head 34 by means of an extensible lead 36.

The thermal head mounts on a telescoping stem 38 affixed to the end wall 40, and urged to extend to contact with a cigarette C at any cigarette usable length by a weak compression spring 42 which may be coaxial with the stem. The bottom of an insulated base 44 for the thermal head guides in the slot 24 in the cigarette retaining tube. Advance of the thermal head knocks ashes onto the battery case downward incline or ash slide above the ash pit.

Preferably, the battery is of the type rechargeable by a lead 46 to a convenience outlet.

It can be seen that the user never has to do more than insert a cigarette, removing a previous butt as necessary, smoke by manipulating switch 14, which may be of the ordinary instantaneous type, having a spring return to the off position represented by arrow 48, and occasionally remove the ashes and recharge the battery.

Finally, not only is it evident that even the users of the invention will not appear particularly noticeable when using it, since smokers frequently remove cigarettes from packs in the manner shown, in the first Figure, and that users of the invention can smoke in more places and can feel much freer to smoke around non-smokers, since they are doing all they can to suppress smoke while indulging, but also it is evident that the invention can protect the health of users to some extent. For the users of the invention, the wavering trail of rising smoke from a parked cigarette will no longer be there to suggest more inhaling to avoid waste, and to pollute further the air the users themselves breathe when not puffing, and users will not inhale sulfur and phosphorous from matches or fumes from liquid or gas lighters.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by Letters Patent of the United States is:

1. A smoke reducer for smokers of cigarettes and the like, comprising: means on the smoke reducer for holding said a cigarette, including a housing with an opening for receiving said a cigarette with a first end of said a cigarette extended for permitting drawing smoke therefrom, the housing having an air vent therein for cigarette ignition and otherwise being substantially air tight;

means on said smoke reducer, including a control having a switch portion, positionable to a first location for concurrently admitting air to and turning on heat for igniting a second end of said a cigarette, and positionable to a second location for extinguishing said a cigarette by turning off said igniting heat and closing said air vent.

2. A smoke-reducer as recited in claim 1, means, having connection with the means positionable, for applying igniting heat to said a cigarette, the means for applying including a thermal head, a stem supporting the thermal head, and means extensibly biasing the thermal head for contacting said a cigarette.

3. A smoke reducer as recited in claim 2, and means adapting the smoke reducer for repeatedly igniting and extinguishing a single said cigarette, including said control comprising an electric switch.

4. A smoke-reducer for smokers of cigarettes and the like, comprising: means, including a housing with an opening for receiving said a cigarette and an air vent for cigarette ignition and otherwise substantially air tight, for holding said a cigarette with a first end extended for drawing smoke therefrom; means positionable to a first location for concurrently admitting air to and turning on heat for igniting a second end of said a cigarette and positionable to a second location for extinguishing said a cigarette, the means positionable including an electric switch for said igiting, the electric switch at the second location turning off the igniting heat and having a portion closing the air vent, the electric switch having a sliding actuator with an extension and said portion closing of the vent being the extension of the sliding actuator, means having connection with the means positionable for applying igniting heat to said a cigarette, the means for applying heat including a thermal head, a stem supporting the thermal head, and means extensible biasing the thermal head for contacting said a cigarette.

5. A smoke-reducer as recited in claim 4, and friction means for holding said a cigarette against the bias of said means for extensibly biasing.

6. A smoke-reducer as recited in claim 5, and means for reducing and containing ashes within the housing.

7. A smoke-reducer as recited in claim 6, the means for holding including a tube having a lower side with a slot therein, and said means for receiving having connection with said slot.

8. A smoke-reducer as recited in claim 7, an incline structure comprising a portion of the structure defining said connection with the means for receiving.

9. A smoke-reducer as recited in claim 8, and a rechargeable battery supplying energy for said igniting through the electric switch.

10. A smoke-reducer as recited in claim 9, said incline comprising a battery container.

11. A smoke-reducer as recited in claim 6, a portion of said means for extensibly biasing having guiding contact with said slot.

* * * * *